United States Patent [19]

Bauchert et al.

[11] 4,263,577

[45] Apr. 21, 1981

[54] ELECTRIC TUBULAR HEATING BODY AND PROCESS FOR ITS MANUFACTURE

[75] Inventors: Jens Bauchert; Ernst Brechner, both of Kandel, Fed. Rep. of Germany

[73] Assignee: Firma Fritz Eichenauer, Kandel, Fed. Rep. of Germany

[21] Appl. No.: 48,442

[22] Filed: Jun. 14, 1979

[30] Foreign Application Priority Data

Jun. 14, 1978 [DE] Fed. Rep. of Germany ..... 2825980

[51] Int. Cl.[3] ..... H01C 1/03

[52] U.S. Cl. ..... 338/242; 29/611; 29/615; 219/552; 219/553; 219/544; 338/238

[58] Field of Search ..... 338/238, 242, 267, 333, 338/334; 219/538, 544, 546–549, 552, 553; 29/610, 611, 614, 615

[56] References Cited

U.S. PATENT DOCUMENTS 1,973,629 9/1934 Hofer ..... 338/241 X 4,101,760 7/1978 Roller ..... 219/544

FOREIGN PATENT DOCUMENTS 730750 5/1932 France ..... 338/242

902739 12/1944 France ..... 29/615

*Primary Examiner*—C. L. Albritton

*Attorney, Agent, or Firm*—Craig and Antonelli

[57] ABSTRACT

An electric tubular heater with a bent jacket tube made of strip material, an electric resistance heating element running in the jacket tube and an electrically insulating embedding material surrounding the resistance heating element. The jacket tube is formed into a closed cross-sectional configuration by deformation of the extremities of the strip material by either bending into an overlapping relationship or by folding the extremities over each other. The bending of the extremities is performed so as to compress the embedding material to its predetermined final density and final cross-sectional configuration according to preferred embodiments.

18 Claims, 5 Drawing Figures

ELECTRIC TUBULAR HEATING BODY AND PROCESS FOR ITS MANUFACTURE

BACKGROUND AND SUMMARY OF THE INVENTION

The invention relates to an electric tubular heater with a bent jacket tube made of strip material, an electric resistance heating element running in the jacket tube, and an electrically insulating embedding material surrounding the resistance heating element. The invention also relates to a process for the manufacture of such a tubular heater.

Such tubular heaters are used in various applications for heating solid, liquid or gaseous media, both for direct heating in direct contact with the medium and also indirectly in such a way that heat release occurs via a heat-permeable surface that is connected so as to be thermally conducting with the said tubular heater. The jacket tube customarily is of a metal that is selected according to requirements with respect to resistance to temperature and corrosion, etc. The electric heat conductor runs inside the jacket tube. The remaining inner space of the jacket tube is filled by the embedding material which must ensure precise positioning of the resistance heating element throughout the life of the tubular heater, and also ensure good electrical insulating properties and a high degree of thermal conductivity. The jacket tube is customarily closed with a seal at its ends, with parts through which the resistance heating element can be carried with appropriate connecting elements.

Ordinarily, in manufacture of tubular heaters of the type in question, one starts with closed tubular profiles for the jacket tube. This profile is cut to the proper length and thereupon the resistance heating element is introduced into the jacket tube, then the tube is charged with embedding material that can be poured, and finally, or possibly after charging with more embedding material, a special device is used to jar it, in order to precompact the embedding material. In connection with this it is necessary to compact the embedding material to its specified final density, by rolling or the like which reduces the cross section. These measures are very time-consuming and expensive in consideration of the devices that are utilized, and therefore they make the manufacture of these known tubular heaters relatively costly. This is especially true of tubular heaters of relatively small dimensions, as used in large numbers for example in household appliances, in which these cost considerations have an even greater significance, as opposed to the relatively low total value of the product.

It is also known from German OS No. 24 18 130 that tubular electric heaters of the described tube can be manufactured continuously, in that the strip material is continuously shaped to a tubular sheath and the abutting long edges are butt-welded together. The resistance heat conductor and the embedding material are supplied vertically at the same time. Compacting of the embedding material by reduction of the cross section is unavoidable in this case also. It is also a drawback that only an extended resistance wire can be placed, whereas helical resistance heating elements that are generally preferred for reasons of energy conservation and adaptation to different conditions of use cannot be processed. Finally, and in particular, it is necessary to protect the embedding material from damage in the welding process, because then contaminants diffused into the embedding material lead to substantial deterioration, especially of the electrical insulating properties. The necessary protective measures are expensive, to the extent that they are effective anyhow.

The invention concerns the problem of producing a tubular heater of the described type that can be manufactured simply and economically with optimal electrical properties, and that will not involve expensive processes for compacting the embedding material. The invention also concerns a process for the manufacture of such a tubular heater.

The problem is solved according to a preferred embodiment of the invention with a tubular heater of the mentioned type that is characterized in that the regions of the long sides of the strip material are folded over each other, to form a closed cross section. In contrast to previously prevailing arrangements, the invention starts with the idea of providing a cohesively closed jacket tube. According to the invention, the jacket tube is rather closed by overlapping and mutual application of the long side regions that are bent over one another, of the flat starting material. Since in the bending over of these long side regions the cross section of the jacket tube is first formed, it is possible in proportion to the embedding material that has been introduced before the bending, to arrive at the required final density in one work step by carrying out the bending accordingly. By simple tests, the quantity of the embedding material can be such that with the final density, the predetermined cross sectional dimensions will likewise be obtained. Moreover, at the same time, with the closing of the cross section by bending over, an essentially random, e.g., round, oval, quadrangular, etc. cross section configuration is produced. A tubular heater according to the invention is produced first in extended form and can subsequently be bent into any desired form.

In many cases of utilization, a simple overlap of the long side regions leads to the necessary density. When the requirements are especially high, there is the possibility of folding the long side regions together and thereby practically completely preventing a gas exchange with the outside air.

Moreover, the requirements for density can be substantially lowered if, according to still further teaching of the invention, the embedding material is made of a finely granular base material of ceramic, advantageously ceramic oxide, and an addition of from 0.5 to 5% parts by weight alkylpolysilonane or arylpolysiloxane, preferably methylpolysiloxane. This organic addition is mixed in with a grain size of 20 to 200 $\mu$m. Such an embedding material is the subject of W. German patent application No. P 25 14 578.2 by the present assignee to which we refer.

A particular advantage of the tubular heater of the invention is to be seen in that it can be made without difficulty with a spiral coiled resistance heating element so that a multiplicity of possible uses with a high specific energy conversion exist.

As far as the process of manufacture is concerned, the invention starts with the fact that the jacket tube of strip material is bent. It is provided according to the invention that the strip material is first to be bent to form a U profile and that the embedding material is placed in the U cavity and the resistance heating element laid in, after which the U extremities of the U profile are bent over one another, with production of a closed cross section. According to the invention it is not necessary that the embedding material be tediously charged into the jacket tube through a narrow cross section in the longitudinal direction, rather, the embedding material can be placed rapidly and efficiently in the open inner chamber of the U profile.

In accordance with the invention, the embedding material does not have to be a material that can be poured. There is no difficulty in using a material of poor rheological properties, or even a pasty one. When the resistance heating element is put in, it can be pressed into the embedding material so that it will be surrounded by it on all sides, and thus be insulated from the jacket tube. Results that are even better as far as reproduction of them is concerned are obtained if first a specific portion of the embedding material is put in, and the rest after insertion of the resistance heating element.

Within the scope of the process according to the invention, there is the possibility of undertaking a post-compacting of the material by reduction of the cross section in a known way. This process is advantageous in that the amount of embedding material that is to be compressed as granules in the bending of the U extremities over each other in such a way that there will be compression to the final predetermined density is facilitated and the required quantity of embedding material to adapt to the intended cross sectional dimensions can be easily managed.

The process of the invention can be executed continuously, particularly in the case of tubular heaters that are relatively short, whose customary method of manufacture is especially uneconomical, but an intermittent process according to the invention has also been found to be particularly advantageous. In the intermittent process, the strip material, before the bending of the U profile (which can be accomplished with ordinary press tools), is cut to its intended length, the resistance heating element in its predetermined length with its closure parts and connecting elements then being laid in, and finally the U extremities are bent simultaneously over their entire length. This again can be done with ordinary press tools.

On the other hand, the flat strip can be first shaped continuously as a U and then cut to the required length.

In any case, the described method of operation ends with tubular heating elements that are ready for connection, that do not require further steps up to a possible bending process. The bending of the U extremities over each other simultaneously over the whole length means that only work tool movements that are perpendicular to the long direction are required. This leads on the one hand to a high working speed and on the other hand to a uniform defined density of the embedding material. Unchecked longitudinal displacements of the embedding material are thereby excluded.

It follows from the above explanations that according to the process of the invention both extended and coiled resistance heating elements can be processed. Moreover, the U extremities can either be simply bent over each other, or if the requirements are for increased density, they can be folded together. Along with the final bending of the U extremities, the jacket tube can be pressed in one and the same work step to a specific essentially random cross section.

In some situations it is advisable, after the introduction of the embedding material and the resistance heating element, first to undertake a precompacting before the bending of the U extremities over each other. This precompacting can be easily done with one stroke of a suitable press tool because the inner cavity of the U profile is freely accessible.

The advantages attained by the invention include that a tubular heating element and a process for its manufacture are given that lead to a substantial simplification and reduction of the outlay for time or apparatus in manufacture. Here above all it is important that resistance heating elements of any desired design can laid in in preassembled state with closing parts and connecting elements, that resistance heating element and embedding material can be placed in the open U cavity in the simplest way, and that the tedious and cumbersome precompacting by jarring, as well as post-compacting by reduction of the cross section become unnecessary. To the extent that precompacting is indicated, this can be effected in a simple way by pressing before the bending together of the U extremities. Impairment of the embedding material, either chemical or physical, is excluded in the process according to the invention.

These and further objects, features and advantages of the present invention will become more obvious from the following description when taken in connection with the accompanying drawings which show, for purposes of illustration only, several embodiments in accordance with the present invention.

Figure 1:
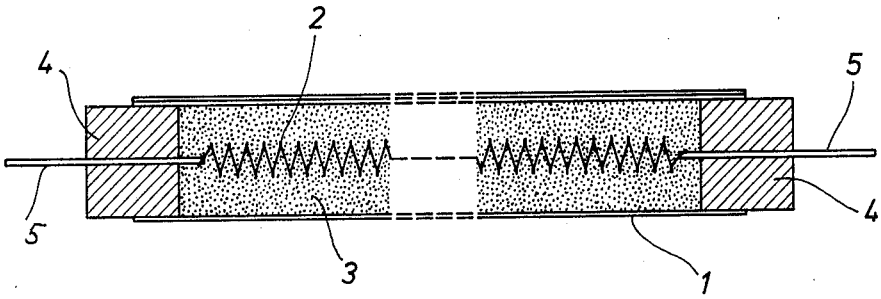
FIG. 1 shows an electrical tubular heater in longitudinal section.
Figure 2A:
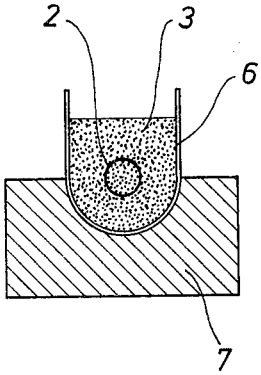
Figure 2B:
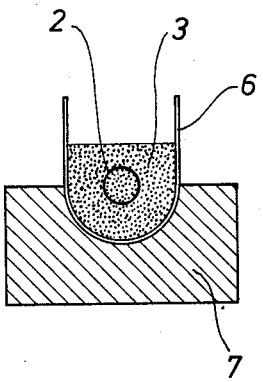
Figure 2C:
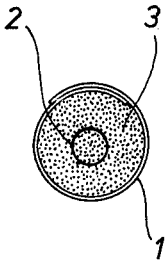
Figure 3:
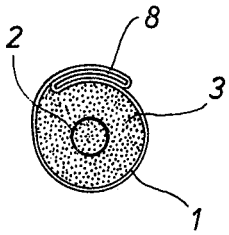

FIGS. *2a–c* show different steps in the production of the electrical tubular heater of FIG. 1;

FIG. 3 is another form of embodiment of the subject of FIG. *2c*.

DETAILED DESCRIPTION OF THE PREFERRED EMBODIMENTS

The tubular heater shown schematically in FIG. 1 is comprised of a metal jacket tube 1, a resistance heating element 2 which in the present example is a coil, and embedding material 3 that fills up the free space inside jacket tube 1. Jacket tube 1 is closed at its ends by plug-like closure parts 4 that are secured against shifting in jacket tube 1 in a way that is not illustrated. Pinlike connecting elements 5 are introduced through closure parts 4, said elements being connected with resistance heating element 2, ensuring its connection to a source of electric current.

FIG. *2a* shows the originally flat strip of material 6 after it has been pressed by means of a press tool (not illustrated) to form a U profile and part of embedding material 3 has introduced into the open U cavity followed by the preassembled resistance heating element 2 with closure parts 4 and connecting elements 5, and finally the rest of the embedding material 3.

FIG. *2b* schematically shows the FIG. *2a* arrangement after the embedding material has undergone an optional precompacting step by means of a press tool (not shown) that can be readily introduced into the open U cavity in the direction of arrow A.

FIG. *2c* shows how finally the cross section of jacket tube 1 has been closed with the U extremities bent over each other with a mutual overlap by per se conventional press tools acting in the direction of arrows B whereby a further compacting to the specified final density of the embedding material occurs. At the same time with the bending together of the extremities of the U-shape jacket tube 1 is pressed to its intended essentially circular cross section.

The embodiment of jacket tube 1 that is shown in FIG. 3 is produced essentially by the steps shown in FIGS. *2a* and *2b*. However, the U extremities are not bent over each other with a simple overlap, but rather they are bent together to form a fold 8, for the sake of increased density, again by conventional apparatus.

According to either of the above processes, the bending of the extremities of the metal sheet material results in a plastic deformation thereof that is sufficient in and of itself to retain the jacket tube 1 closed without the need for additional welding or other joining steps.

We claim:

1. Electrical tubular heating element with a jacket tube formed from a single bent strip of material, an electrical resistance heating element running in the jacket tube, and an electrically insulating embedding material surrounding the resistance heating element, characterized by the fact that the embedding material is composed of a fine-grained base material made of a ceramic material with a polysiloxane selected from the group consisting of alkylpolysiloxane and arylpolysiloxane added, and by the fact that the longitudinal side areas of said strip are joined solely by being bent one over the other to form a closed cross-section and to rest flat against one another.

2. Tubular heating element according to claim 1, characterized by the fact that the polysiloxane comprises 0.5 to 5 wt%.

3. Tubular heating element according to claim 2, characterized by the fact that the polysiloxane is an alkylpolysiloxane.

4. Tubular heating element according to claim 3, characterized by the fact that polysiloxane is a methylpolysiloxane.

5. A tubular heater as in claim 1, characterized in that the resistance heating element is coiled.

6. A tubular heater as in claim 2, characterized in that the resistance heating element is coiled.

7. Tubular heating element according to claim 2, characterized by the fact that the polysiloxane is an arylpolysiloxane.

8. Method of manufacturing an electrical tubular heating element consisting of a jacket tube, an electrical resistance heating element, and an embedding material, whereby the jacket tube is bent from a single strip of material, comprising the steps of bending said single strip to form a U-shaped profile, placing an embedding material composed of a fine-grained base material made of ceramic material with a polysiloxane selected from the group consisting of arylpolysiloxane and an alkylpolysiloxane added and the resistance heating element in an inner cavity of the U-shaped profile, and joining extremities of the U-shaped profile solely by bending one over the other to form a closed cross-section.

9. A process as in claim 8, wherein the step of bending the extremities is performed so as to compress the embedding material to its predetermined final density.

10. A process as in claim 8, wherein the step of placing the embedding material and the resistance heating element in the U cavity is followed by the step of precompacting the embedding material by pressing.

11. A process as in claim 8, characterized in that first a predetermined fraction of the embedding material is put into place and after the laying in of the resistance heating element, the remaining embedding material is put in.

12. A process as in claim 10, characterized in that first a predetermined fraction of the embedding material is put into place and after the laying in of the resistance heating element, the remaining embedding material is put in.

13. A process as in claims 8 or 11, characterized in that the strip material is shortened to the desired length before being bent to the U profile, in that the resistance heating element is laid in in its predetermined length and provided with connecting parts and connecting elements, and in that the extremities of the U profile are bent at the same time over their whole length.

14. A process as in claim 12, characterized in that the strip material is shortened to the desired length before being bent to the U profile, in that the resistance heating element is laid in in its predetermined length and provided with connecting parts and connecting elements, and in that the extremities of the U profile are bent at the same time over their whole length.

15. A process as in claim 10, wherein the jacket tube is pressed to a predetermined final cross-sectional configuration during the bending step and retained therein by plastic deformation.

16. A process as in claim 8, wherein the jacket tube is pressed to a predetermined final cross-sectional configuration during the bending step and retained therein by plastic deformation.

17. An electrical tubular heater produced by the process of claims 8 or 9.

18. An electrical tubular heater produced by the process of claim 16.

* * * * *